United States Patent [19]

Tarumi et al.

[11] Patent Number: 4,965,485

[45] Date of Patent: Oct. 23, 1990

[54] HALOGEN LAMP ENVELOPE WITH ROUGHENED SURFACE AREA AND OPTICAL FILM

[75] Inventors: Kazuo Tarumi; Tsutomu Watanabe, both of Yokosuka, Japan

[73] Assignee: Kabushiki Kaisha Toshiba, Kawasaki, Japan

[21] Appl. No.: 281,856

[22] Filed: Dec. 9, 1988

[30] Foreign Application Priority Data

Feb. 10, 1988 [JP] Japan ..... 63-27670

[51] Int. Cl.[5] ..... H01J 5/16

[52] U.S. Cl. ..... 313/43; 313/41; 313/111; 313/112; 313/578; 313/579

[58] Field of Search ..... 313/39, 41, 43, 44, 313/111, 112, 578, 579

[56] References Cited

U.S. PATENT DOCUMENTS

| | | | |
|---|---|---|---|
| 1,599,241 | 9/1926 | Mery | 313/44 |
| 4,524,410 | 6/1985 | Kawakatsu et al. | 313/112 X |
| 4,634,919 | 1/1987 | Yuge et al. | 313/112 X |
| 4,677,338 | 6/1987 | Dixon et al. | 313/43 |

*Primary Examiner*—Donald J. Yusko
*Assistant Examiner*—Michael Horabik
*Attorney, Agent, or Firm*—Cushman, Darby & Cushman

[57] ABSTRACT

A halogen lamp having a translucent glass envelope containing a halogen-containing gas sealed therein and including an outer surface and a connection end. The lamp further has a tungsten filament sealed within the envelope for generating light containing visible light and infrared rays, lead-in conductors for connecting the lamp to a source of electricity, molybdenum foils embedded within the connection end of the envelope for electrically connecting the filament to the lead-in conductors and an optical film coated on at least a portion of the envelope for reflecting the infrared rays and transmitting the visible light, the reflected infrared rays generating heat within the envelope which is transmitted by conduction through the envelope, the envelope also including a roughened area free from the optical film on the outer surface between the optical film and the connection end for interrupting the transmission of the heat through the envelope to the molybdenum foils.

7 Claims, 4 Drawing Sheets

HALOGEN LAMP ENVELOPE WITH ROUGHENED SURFACE AREA AND OPTICAL FILM

FIELD OF THE INVENTION

The present invention relates generally to a halogen lamp, and more particularly, to a tungsten halogen lamp.

BACKGROUND OF THE INVENTION

Typically, a tungsten halogen lamp comprises a tubular glass bulb, a molybdenum lead-in foil, a tungsten coil filament and halogen gas filled in the space of the bulb together with inert gas, such as argon. The molybdenum leading foil is embedded in a sealed end of the bulb. The tungsten coil filament is housed in the space of the bulb and electrically connected to the molybdenum lead-in foil.

Recently, tungsten halogen lamps have been coated with a prescribed optical film which passes visible light therethrough, but reflects infrared rays. The optical film is coated on at least one of the inner and outer wall surfaces of the bulb.

In such a tungsten halogen lamp, the visible light emitted from the tungsten filament passes through the optical film and radiates to the outside of the bulb. The infrared rays are reflected by the optical film. A part of the reflected infrared rays return to the filament and heat it up. Thus, the luminous efficiency of the tungsten filament is increased. Furthermore, the optical film reduces the component of infrared rays contained in the light radiated outside the lamp, so that the optical film decreases damage to objects being illuminated caused by excessive heat.

Another portion of the reflected infrared rays is applied to another portion of the optical film and again is reflected thereby toward the inside of the bulb. Thus, a relatively large amount of the infrared rays reach the sealed part and heat the molybdenum lead-in foil embedded in the sealed part.

The temperature of the bulb wall in such a tungsten halogen lamp is set to a relatively high temperature in order to carry out a halogen regeneration cycle on the wall surface of the bulb. The high temperature of the bulb wall is transmitted by conduction to the sealed part of the bulb.

Thus, the molybdenum lead-in foil is intensively heated by the infrared rays directly and indirectly applied thereto. The molybdenum lead-in foil deteriorates due to oxidization caused by the high temperature. This deterioration damages the sealing of the sealed end around the molybdenum lead-in foil, so that gas leakage from the bulb is accelerated. As a result, the life of the halogen lamp is decreased.

SUMMARY OF THE INVENTION

It is, therefore, an object of the present invention to provide a halogen lamp in which the deterioration of a sealing of a lamp bulb is improved in comparison to the conventional ones.

Another object of the present invention is to provide a halogen lamp in which a sealing part of a lamp bulb is prevented from overheating by infrared rays directly and indirectly applied thereto.

In order to achieve the above object, a halogen lamp according to one aspect of the present invention has a translucent glass envelope containing a halogen-containing gas sealed therein and including an outer surface and a connection end. The lamp further has a tungsten filament sealed within the envelope for generating light containing visible light and infrared rays, lead-in conductors for connecting the lamp to a source of electricity, molybdenum foils embedded within the connection end of the envelope for electrically connecting the filament to the Lead-in conductors and an optical film coated on at least a portion of the envelope for reflecting the infrared rays and transmitting the visible light, the reflected infrared rays generating heat within the envelope which is transmitted by conduction through the envelope, the envelope also including a roughened area free from the optical film on the outer surface between the optical film and the connection end for interrupting the transmission of the heat through the envelope to the molybdenum foils.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
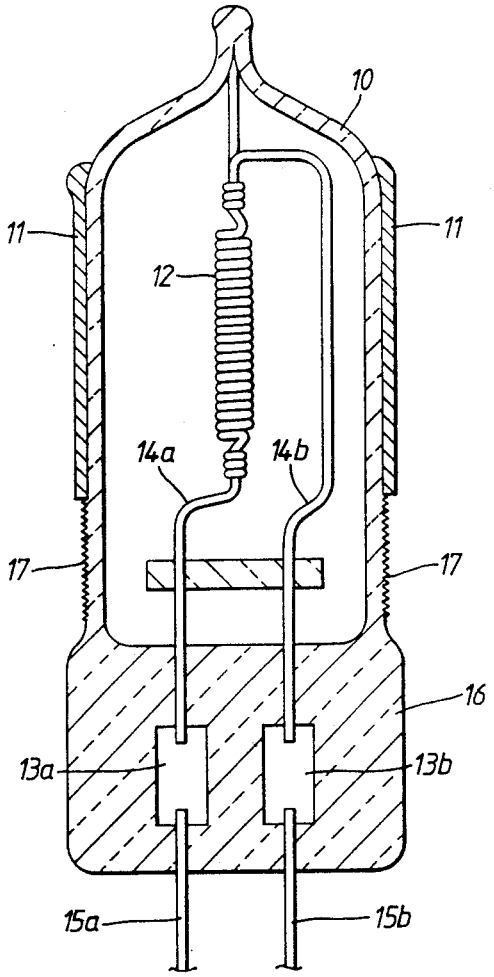
FIG. 1 is a sectional view showing an embodiment of the halogen lamp according to the present invention.

The present invention will be described in detail with reference to the drawings, FIGS. 1 to 6. Throughout the drawings, same or identical reference numerals and letters will be used to designate like or equivalent elements for simplicity of explanation.

Figure 2:
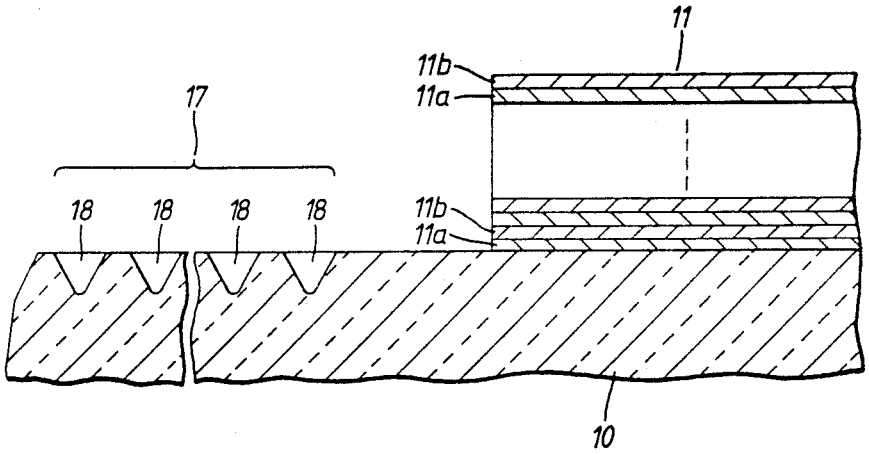
FIG. 2 is an enlarged sectional view showing a part of the halogen lamp of FIG. 1.

Referring now to FIGS. 1 and 2, a first embodiment of the halogen lamp according to the present invention will be described in detail. FIG. 1 is a section view showing a uni-base type tungsten halogen lamp. FIG. 2 is an enlarged sectional view showing a part of the halogen lamp of FIG. 1.

In FIG. 1, the halogen lamp comprises a tubular-shape bulb 10, a visible light passing and infrared ray reflecting film (referred as an optical film hereafter) 11, a tungsten coil filament 12, a pair of molybdenum lead-in foils 13*a* and 13*b*, a pair of inner conductors 14*a* and 14*b* and a pair of outer conductors 15*a* and 15*b*.

The bulb 10 is made of a quartz glass. The bulb 10 has a sealed part 16 on one end thereof. A predetermined amount of halogen-containing gas is filled into the space defined by the bulb 10, together with an inert gas such as argon.

The molybdenum lead-in foils 13*a* and 13*b* are embedded in the sealed part 16. One end of each of the inner conductors 14*a* and 14*b* is embedded in the sealed part 16 and connected to one of the molybdenum lead-in foils 13*a* and 13*b*, respectively. The other end of each of the inner conductors 14*a* and 14*b* is connected to a different end of the filament 12. Thus, the filament 12 is suspended in the space of the bulb 10. One end of each of the outer conductors 15*a* and 15*b* is embedded in the sealed part 16 and connected to one of the molybdenum lead-in foils 13*a* and 13*b*, respectively The other end of each of the outer conductors 15*a* and 15*b* protrudes outside the bulb 10.

The optical film 11 is coated on the outer wall surface of the bulb 10, surrounding the portion of the wall opposite to the filament 12. The optical film 11 comprises a plurality of layers, as described in detail later. A part of the outer wall surface of the bulb 10 between the sealed part 16 and the optical film 11 is made to a rough surface 17.

Referring now to FIG. 2, the optical film 11 and the rough surface 17 will be described in detail. FIG. 2 shows an enlarged section around the optical film 11 and the rough surface 17.

The optical film 11 is a kind of light interference film comprising multiple layers, one upon the other. Further, the rough surface 17 is formed on the outer surface of the bulb 10 by, for example, mechanical or chemical processing.

The optical film 11 includes high refractory index layers 11 a (shown by the hatching lines ascending leftward) having thickness of about 1100 Å and made of titanium oxide and low refractory index layers 11*b* (shown by the hatching lines ascending rightward) having thickness of about 1700 Å and made of silica ($SiO_2$) piled up alternately in total 15–20 layers. Thus, the optical film 11 has a light interference property of high transmittivity for visible Light and high reflectivity for infrared rays. Further, the rough surface 17 may be formed by sandblasting the outer surface of the bulb 10 so that fine hollows 18 about 1 μm in depth are defined on the surface.

To obtain such the optical film 11, the bulb 10 is alternately dipped into an organic titanium compound solution and an organic silicon compound solution. The solution coatings are baked successively after each dipping After the completion of the optical film 11 on the outer wall surface of the bulb 10, the portion of the outer wall between the optical film 11 and the sealed part 16 is formed into the rough surface 17 by sandblasting. At this time, a certain distance can be left between the optical film 11 and the rough surface 17.

Now, the operation of the tungsten halogen lamp will be explained. When the halogen lamp is lighted, a large amount of infrared rays are emitted from the filament 12 together with visible light. This visible light and the infrared rays emitted from the filament 12 in the radial direction of the bulb 10 are applied to the optical film 11. The visible light is transmitted through the optional film 11 and radiated to the outside of the halogen lamp. The infrared rays are reflected by the optical film 11. A portion of the reflected infrared rays returns to the filament 12. Thus the infrared rays heat up the filament 12, so that the light emitting efficiency of the filament 12 is increased.

A part of each of the visible Light and the infrared rays is transmitted through the glass wall of the bulb 10 to the rough surface portion 17 by reflection inside the glass wall of the bulb 10. The visible light and the infrared rays reaching the rough surface portion 17 are diffusively radiated outside the halogen lamp therefrom. Therefore, the amounts of the visible light and the infrared rays reaching the sealed part 16 are reduced.

Further, the bulb 10 is designed to be heated to a high temperature capable of preventing adhesion of tungsten halide to the bulb wall by increasing the maximum load of the bulb wall so that a halogen regenerative cycle is carried out in the halogen lamp. The heat due to the high temperature of the glass wall of the bulb 10 is conducted to the sealed part 16. However, the rough surface part 17 radiates heat by its expanded surface area and also radiates the infrared rays, so that the temperature of the rough surface part 17 is lowered.

Thus, according to the present invention, infrared rays applied to the sealed part 16 through reflection by the optical film 11 and reflection inside of the glass wall of the bulb 10 are radiated to outside the halogen lamp from the rough surface portion 17, which is so formed as to provide a larger surface area between the wall portion corresponding to the location of the optical film 11 and the sealed part 16 of the bulb 10. The heat of the halogen lamp is also radiated from the rough surface portion 17. Therefore, this heat radiation from the outer surface of the bulb 10 can prevent an increase of the temperature at the part of the bulb 10 ranging from the rough surface 17 to the sealed part 16.

In this connection, the inventors carried out tests for three samples, A, B and C, embodying the present invention, a conventional art and a comparative one other than above. In each of the samples A, B and C, the bulb 10 was made of silica glass and had the same dimensions. The outside diameter was 14 mm, the thickness of the bulb wall was 1 mm the overall length of the bulb 10 including the sealed end 16 was 96 mm, in reference to the construction of FIG. 2. The tungsten filament 12 sealed in the bulb 10 had the same rating of 100 V and 500 W. The two molybdenum lead-in foils 13*a* and 13*b* embedded in the sealed end 16 had the same dimensions. The width was 3 mm, the thickness was 0.031 mm and the length was 6 mm. The sample A embodying the present invention further had an optical film 11 and a rough surface portion 17. The optical film 11 was provided on the outer surface of the central portion of the bulb 10. The rough surface portion 17 was formed near the sealed end 16 across a band width of about 2 mm and defined with hollows of about 1 μm depth. The sample B embodying the conventional art further had the optical film 11, but the portion corresponding to the rough surface portion 17 was left uniform. The comparative sample C had both the optical film 11 and the rough surface portion 17. However the optical film 11 extended to the boundary between the bulb 10 and the sealed end 16 The rough surface portion 17 was made on the sealed end 16 by sandblasting.

In the test, the temperatures of the sealed ends 16 of the samples A, B and C were measured by conforming to the testing standard; JIS C-7527. The result of the test is shown in the following Table. Further, the environmental temperature during the the test was 30° C.

| Test Sample | Temperature at (°C.) Sealed Part |
|---|---|
| (A) Sample Embodying the Present Invention | 320 |
| (B) Sample Embodying a Conventional Art | 390 |
| (C) Comparative Sample Other Than Above | 370 |

As clearly seen from the table, the temperature of the sealed part 16 of Sample A embodying the present invention was significantly lower than Samples B and C.

In the embodiment as mentioned above, the optical film was formed by laying alternately high refractive index layers made of titanium oxide and low refractive index layers made of silica. However, the high refractive index layers can be made of other materials such as tantalum oxide, tin oxide, etc. The low refractive index layer also can be made of other materials such as calcium fluoride, aluminium fluoride and etc. Furthermore, the optical film can be any film capable of providing the infrared ray reflecting action as described above including films using other optical principles, other than optical interference films.

The present invention is not limited to the above embodiments, but can be modified to various forms, as described below.

Figure 3:
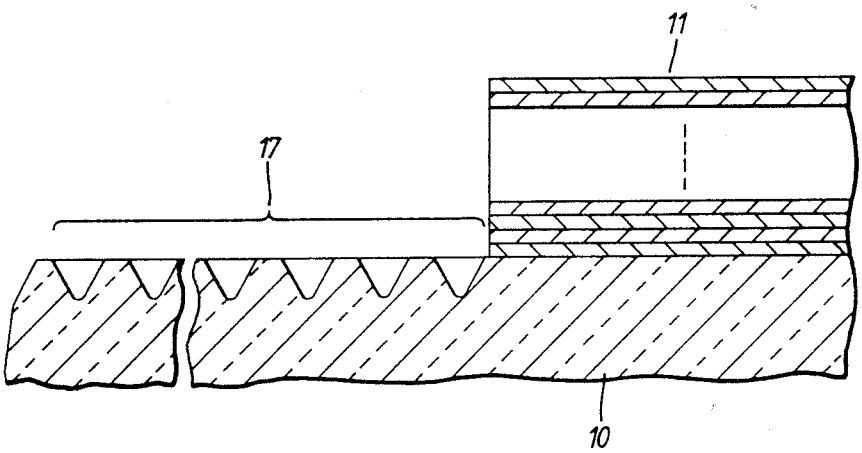
FIG. 3 is a sectional view showing a part of a first modification of the halogen lamp of FIG. 1.
Figure 4:
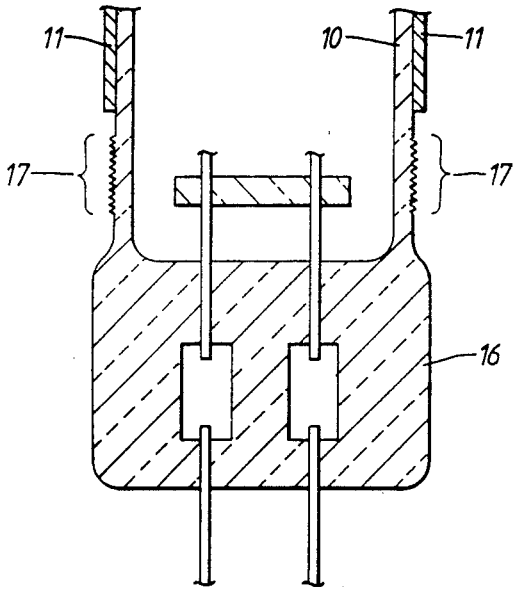
FIG. 4 is a sectional view showing a part of a second modification of the halogen lamp of FIG. 1.
Figure 5:
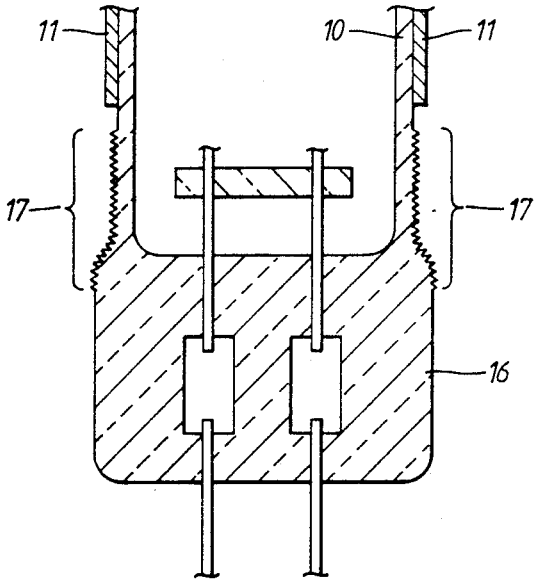
FIG. 5 is a sectional view showing a part of a third modification of the halogen lamp of FIG. 1.

Although a short distance is provided between the rough surface portion and the optical film and no gap is provided between the rough surface portion and the sealed part in the embodiment, any distance between the rough surface 17 and the optical film 11 can be removed, as shown in FIG. 3. Further, a certain distance can be provided between the rough surface 17 and the sealed part 16, as shown in FIG. 4. Also, a part of the rough surface 17 can be extended over the outer surface of the sealed part 16, as shown in FIG. 5. All of &he above modifications have the same beneficial effects as the embodiment In addition, the forming method of the rough surface 17 is not limited to sandblasting. A grinding method using a grinder, an etching method or a molding method performed by using molds during the shaping of the bulb 10 or the sealing of the bulb end 16 can be used. In summary, the formation of the rough surface 17 can be modified in reference to heat radiation principles in which either the infrared ray radiation or the convection is applicable.

Figure 6:
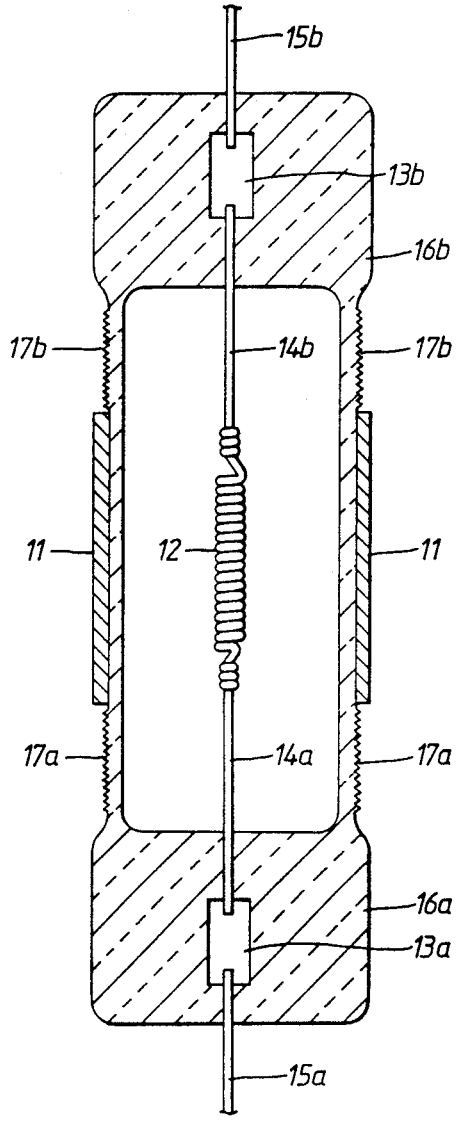
FIG. 6 is a sectional view showing a second embodiment of the halogen lamp according to the present invention.

FIG. 6 shows a second embodiment of the present invention. In the second embodiment a pair of sealed parts 16*a* and 16*b* are formed on both ends of the bulb 10. And accordingly, the molybdenum lead-in foils 13*a* and 13*b* can be embedded in both the sealed ends 16*a* and 16*b*. In this case, two rough surfaces 17*a* and 17*b* can be provided on the outer surface of the bulb 10, one close to each of the sealed ends 16*a* and 16*b*.

In addition, the bulb 10 is not limited to silica glass, but the bulb 10 can be made of other heat resisting glass, such as aluminum-silicate glass, borosilicate, etc.

As described above, the present invention can provide an extremely preferable halogen lamp.

While there has been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A halogen lamp, comprising:

a translucent glass envelope having a halogen-containing gas sealed therein, the envelope including an outer surface and a connection end;

a filament sealed within the envelope for generating light, including visible light and infrared rays:

lead-in means for connecting the lamp to a source of electricity;

metal foil embedded within the connection end of the envelope for electrically connecting the filament to the lead-in means, and an optical film on a portion of the envelope for reflecting the infrared rays and transmitting the visible light, the reflected infrared rays generating heat within the envelope which is transmitted by conduction through the envelope, the envelope aLSO including roughened area means free from the optical film means on the outer surface between the optical film means and the connection end for interrupting the transmission of the heat through the envelope to the metal foil means.

2. The lamp of claim 1 wherein the roughened area means include a band of sandblasted glass surrounding the envelope.

3. The lamp of claim 2 wherein the band includes a plurality of hollows, a substantial portion of the hollows having a depth of about 1 μm.

4. The lamp of claim 1 wherein the envelope includes a smooth surface between the optical film means and the roughened areas means.

5. The lamp of claim 1 wherein the envelope include a thin-walled bulb and the connecting end includes a thick glass base, and the roughened area means extend over a portion of the base.

6. The lamp of claim 1 wherein the envelope includes a smooth gap between the roughened area means and the connection end.

7. A halogen lamp, comprising:

a translucent glass envelope having a hologen-containing gas sealed therein, the envelope including an outer surface and two connection ends;

a filament sealed within the envelope for generating light, including visable light and infrared rays;

lead-in means for connecting the lamp to a source of electricity;

molybdenum metal foil embedded within each connection end of the envelope for electrically connecting the filament to the lead-in means; and an optical film on a portion of the envelope for reflecting the infrared rays and transmitting the visable light, the reflected infrared rays generating heat within the envelope which is transmitted by conduction through the envelope, the envelope also including roughened area means, free from the optical film, on the outer surface between the optical film and each connection end for interrupting the transmission of the heat to the foils.

* * * * *